United States Patent [19]

Marass et al.

[11] Patent Number: 4,555,989

[45] Date of Patent: Dec. 3, 1985

[54] APPARATUS FOR WASHING A RUBBER BLANKET CYLINDER OF A PRINTING MACHINE

[75] Inventors: Josef Marass, Seehausen; Rudolf Liepert, Augsburg, both of Fed. Rep. of Germany

[73] Assignee: Georg Spiess GmbH, Gersthofen, Fed. Rep. of Germany

[21] Appl. No.: 585,821

[22] Filed: Mar. 2, 1984

[30] Foreign Application Priority Data

Mar. 14, 1983 [DE] Fed. Rep. of Germany ..... 3308980

[51] Int. Cl.[4] ..... B41F 35/02; B41L 41/02

[52] U.S. Cl. ..... 101/424

[58] Field of Search ..... 101/423, 424, 425

[56] References Cited

U.S. PATENT DOCUMENTS

| | | | |
|---|---|---|---|
| 693,044 | 2/1902 | Miehle | 101/423 |
| 2,525,982 | 10/1950 | Wescott | 101/425 |
| 3,120,805 | 2/1964 | Simon | 101/425 |
| 3,309,993 | 3/1967 | Grembecki | 101/425 |
| 3,467,011 | 9/1969 | Phelps | 101/425 |
| 3,763,778 | 10/1973 | Sills | 101/425 |
| 4,015,307 | 4/1977 | Kossak | 101/425 |
| 4,058,059 | 11/1977 | Moestue | 101/425 |
| 4,135,448 | 1/1979 | Moestue | 101/425 |
| 4,344,361 | 8/1982 | MacPhee | 101/425 |
| 4,397,235 | 8/1983 | Fischer | 101/425 |

*Primary Examiner*—Edgar S. Burr

*Assistant Examiner*—William L. Klima

*Attorney, Agent, or Firm*—Wolf, Greenfield & Sacks

[57] ABSTRACT

The present specification discloses an apparatus for washing a rubber blanket cylinder of a printing machine. The apparatus comprises a cleaning cloth which extends between a supply roll and a take-up roll, with control and drive means adapted to rotate the take-up roll in a step-wise manner to thus take up uniform lengths of cleaning cloth. A rotatable guide roller is arranged to press the cleaning cloth between said rolls, against the rubber blanket cylinder, the rotatatable guide roller having a resiliently deformable outer surface across which the cleaning cloth is guided. A reversible brush roller is located upstream of the rotatable guide roller in the direction of rotation of the rubber blanket cylinder, and is in contact with said cylinder, and a cleaning agent supply and a water supply are arranged to feed said brush roller. Said control and drive means comprises a crank which acts upon a lever via a connecting rod, said lever being connected to a take-up shaft, in which the take-up roll is mounted, by way of a one-way clutch. The point at which the connecting rod acts upon said lever is variable dependent upon the quantity of cleaning cloth taken up by said take-up roll. The width of the cleaning cloth corresponds only to a portion of the length of the cylinder, and guide and operating means are provided for moving the apparatus transversely along the entire length of the cylinder.

6 Claims, 5 Drawing Figures

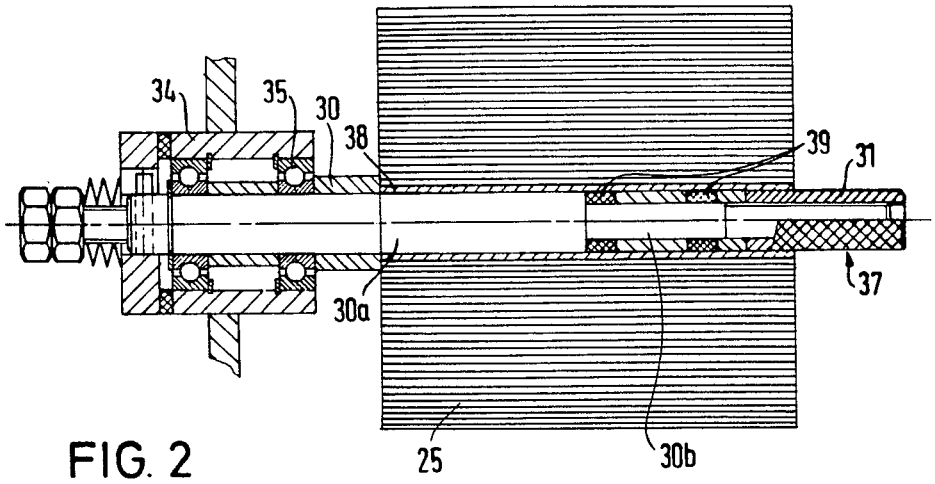
FIG. 2
FIG. 3
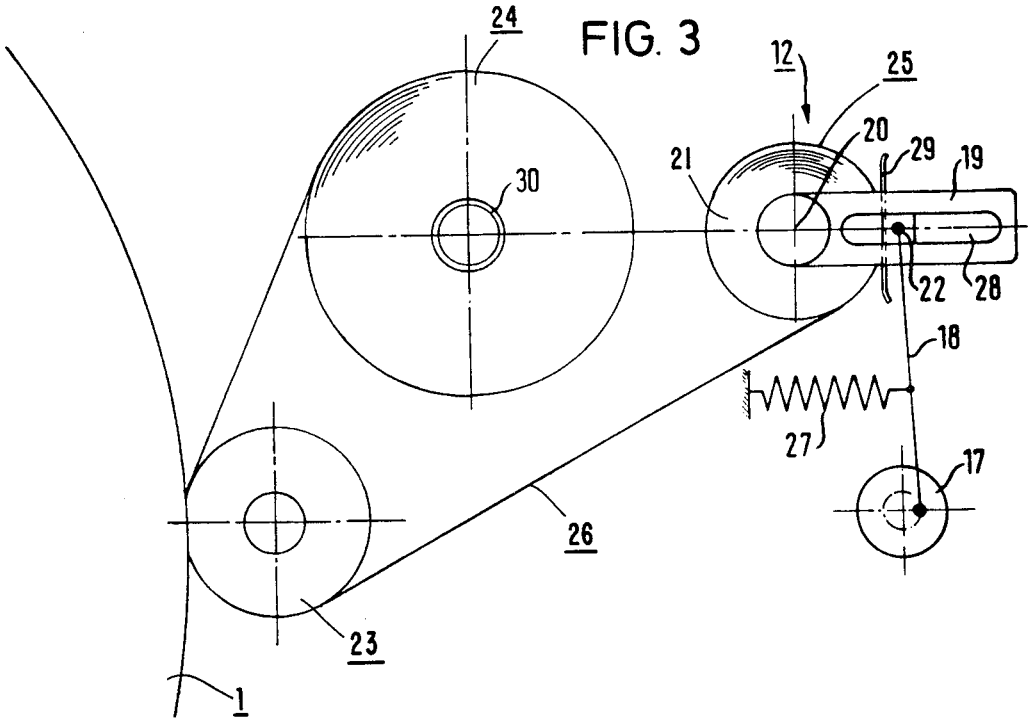

APPARATUS FOR WASHING A RUBBER BLANKET CYLINDER OF A PRINTING MACHINE

DESCRIPTION

The present invention relates to a washing apparatus for a rubber blanket cylinder of a printing machine.

The constant demand for rationalization in offset printing results in, inter alia, the necessity for the use of an automatically operating apparatus for cleaning the rubber blanket cylinder of a printing machine, particularly an offset printing machine. It is necessary to clean the rubber blanket at varying intervals of time, since residues of ink and printed matter are deposited on the rubber blanket, hence reducing the printing quality.

Very high demands with respect to the cleaning effect, manipulation, reliable operation and economy are placed on a cleaning or washing apparatus of this kind.

German Auslegesschrift No. 25 22 743 describes an apparatus for cleaning the offset cylinder of a lithographic offset printing machine, in which a motor-driven plate-like disc, whose axis of rotation lies in a plane at right angles to the axis of rotation of the offset cylinder, cleans the surface of the offset cylinder by means of brushes on its front surface, which can be brought into contact with the surface of the offset cylinder. The disc is moved back and forth along the surface of the offset cylinder by means of an advance device. The advance device comprises a screw-threaded spindle which engages a housing of the disc, a guide rod holding the housing being disposed parallel to the screw-threaded spindle and reversible drive means being provided for rotating the screw-threaded spindle in two directions of rotation. Cleaning fluid is fed to the brushes on the disc when the disc is at one or both of its end positions.

The disadvantage of a disc and brushes of this kind, resides in the fact that it only has a limited degree of absorption for the residues to be removed from the rubber blanket, since the same cleaning surface constantly comes into contact with the rubber blanket cylinder, thereby preventing an optimum cleaning effect. Furthermore, the adjacent parts of the machine are soiled by the washing agent which is spun off tangentially in all directions.

German Offenlegungsschrift No. 28 04 801 describes a rubber blanket washing apparatus in which a brush roller is used as a means for pressing a cleaning cloth against a rubber blanket cylinder. The cleaning cloth extends across the entire width of the rubber blanket cylinder, and washing fluid is fed to the cleaning cloth by a metal component made from sintered material. However, this water and washing agent feed does not enable precise metering to be achieved since varying pressure conditions prevail in the feed line made from sintered material. Further, the cleaning cloth is wetted by its own absorbency even when the supply of fluid is shut off, and the porous feed line gradually becomes empty. Also, the guiding of the cleaning cloth over the brush roller does not permit uniform pressure against the rubber blanket, since the pressure is dependent upon the more or less greatly fluctuating tensile stress of the cleaning cloth.

German Auslegesschrift No. 1 124 974 describes a cleaning apparatus for the rubber blanket cylinder of offset printing machines. This cleaning apparatus comprises two contra-rotating brush rollers, the cleaning fluid being fed through the hollow shafts of the brush rollers.

This cleaning apparatus requires large quantities of water and washing agent, since the water and the washing agent emerge from the hollow shafts on all sides, so that only a fraction of the water or washing agent is applied to the rubber blanket of the impression cylinder for the purpose of cleaning it. Hence, this apparatus is uneconomical and its cleaning action is unsatisfactory.

Finally, in a washing apparatus for the impression cylinder of a printing machine, German Offenlegungsschrift No. 30 05 469 describes the use of a cleaning cloth which extends across the entire width of the cylinder and which runs from a supply shaft by way of a pressure means to a take-up roller where it is taken up by substantially the same amount at each feed step by means of a feed means co-operating with the take-up roller. The pressure means comprises a bendable component which is bent when in the pressing position and relieved of stress when in its normal position. Feed means for step-wise feeding of the cleaning cloth, comprises a drive which is operatively connected to a one-way clutch to drive the take-up roller in one direction, and a control which acts upon the cleaning cloth on the take-up roller and controls the rotation of the take-up roller in dependence upon the amount of cleaning cloth on the take-up roller. The control comprises a crankshaft arm which is operatively connected to the one-way clutch and which can rotate with the shaft driven by the one-way clutch. A carriage holder is provided on the crankshaft arm and can be displaced along the crankshaft arm radially of the axis of the take-up roller.

A crank pin is operatively connected to the carriage holder and is in contact with the cleaning cloth on the take-up roller and can be radially displaced with the carriage holder relative to the axis of the take-up roller and can move with the carriage along an arc about the axis of the take-up roller. Furthermore, a stop for the crank pin is provided in order to limit the rotary movement of the take-up roller. Water and cleaning agent is fed to the cleaning cloth for the purpose of cleaning the rubber blanket impression cylinder.

This washing apparatus is of relatively large construction. Further, the control for the step-wise movement of the cleaning cloth is very complicated. Furthermore, this washing apparatus requires a considerable amount of handling, since cleaning cloths of such a large width have to be very carefully applied, since they otherwise have the tendency to form folds, hence resulting in an unsatisfactory cleaning effect. Used cleaning cloths have to be wound back on to the supply shaft before they are replaced. Furthermore, cleaning cloths of different widths are required for printing machines of different formats, so that it is necessary to keep a large number of cleaning cloths in stock. Finally, since, in the known apparatus, the cleaning cloth is pressed against the impression cylinder by bending the component when in its working position, a relatively large amount of tension has to be exerted on the cleaning cloth for the purpose of feeding it from the supply shaft to the take-up shaft. This means that, on the one hand, tearing of the cleaning cloth cannot be excluded, and that, on the other hand, the components of the cleaning cloth feed means have to be of correspondingly strong construction.

Hence, the object of the present invention is to provide a washing apparatus for a rubber blanket cylinder of a printing machine which, with a reduced overall size, achieves an improved cleaning action.

According to the present invention there is provided an apparatus for washing a rubber blanket cylinder of a printing machine, comprising a cleaning cloth which extends between a supply roll and a take-up roll, control and drive means adapted to rotate the take-up roll in a step-wise manner to thus take up uniform lengths of cleaning cloth, and a rotatable guide roller arranged to press the cleaning cloth between said rolls, against the rubber blanket cylinder, the rotatable guide roller having a resiliently deformable outer surface across which the cleaning cloth is guided, a reversible brush roller being provided upstream of the rotatable guide roller in the direction of rotation of the rubber blanket cylinder, and being in contact with said cylinder, a cleaning agent supply and a water supply being arranged to feed said brush roller, and said control and drive means comprising a crank which acts upon a lever via a connecting rod, said lever being connected to a take-up shaft, in which the take-up roll is mounted, by way of a one-way clutch, the point at which the connecting rod acts upon said lever being visible dependent upon the quantity of cleaning cloth take-up by said take-up roll, the width of the cleaning cloth only corresponding to a portion of the length of the cylinder, and guide and operating means being provided for moving the apparatus transversely along the entire length of the cylinder.

The present invention thus provides a washing apparatus for a rubber blanket cylinder of a printing machine, in which water as well as solvent are sprayed on to a rotating brush roller having a reversible direction of rotation. When the apparatus is running in a forward direction, the direction of rotation of the brush roller is chosen such that particles of dirt and ink which have been brushed loose are centrifuged into a collecting trough disposed below the brush roller. The brush roller is rotated in the opposite direction when the cleaning apparatus is moved in the reverse direction, the means for feeding the cleaning cloth being simultaneously activated. The water and washing agent which continue to be fed is spun off towards the cleaning cloth by the then prevailing direction of rotation of the brush roller, advantageously promoting the wetting of the cleaning cloth. The cleaning operation thus taking place in two phases, results in very economic consumption of cleaning cloth, since the dirt centrifuged into the receiving trough does not have to be absorbed by the cleaning cloth. The cleaning effect of the washing apparatus in accordance with the invention is increased by crosswise wiping and brushing of the rubber blanket cylinder in that the washing apparatus is advanced by a specific amount parallel to the axis of the cylinder during each rotation of the cylinder. Furthermore, the cleaning agent mixed with water is largely separated from the wiping cloth, since the greater portion of the fluid is collected in the collecting trough, thereby substantially simplifying waste disposal.

Since the apparatus in accordance with the invention uses a cleaning cloth whose width only corresponds to a fraction of the width of the rubber blanket, the exchange of a used cleaning cloth is substantially facilitated. The special arrangement of the take-up shaft also makes it unnecessary to rewind the cleaning cloth. Furthermore, in the case of a narrow, strip-shaped cleaning cloth as provided by the invention, there is no risk of the formation of folds and thus no risk of impairment of the cleaning effect. Only a single standard width of cleaning cloth roll is used in the washing apparatus in accordance with the invention, thereby substantially simplifying stock-keeping and acquisition.

Since, in accordance with the invention, the pressing means is a resiliently deformable guide roller, there is no need to provide further measures for pressing the cleaning cloth. Moreover, the guide roller is rotatably mounted, so that only small forces have to be exerted on the cleaning cloth for the purpose of feeding it. Damage to the cleaning cloth is thereby avoided. Furthermore, the conveying components can be of corresponding light construction and can be driven without unnecessary expenditure of energy.

The resilient construction of the guide roller can be achieved by making it entirely from resilient material. Alternatively, however, it is conceivable to realise the resilience of the guide roller in that only its surface which is applied to the cleaning cloth is of resilient construction. A preferred embodiment of the latter possibility resides in the fact that the guide roller comprises a tubular portion on the surface of which is provided a toroidal membrane. The space between the outer surface of the tube and the toroidal membrane is a substantially cylindrical volume which can be filled with compressed air.

In the washing apparatus in accordance with the present invention, the wetting of the cleaning cloth with water and washing agent is effected at the side facing the rubber blanket, so that water and washing agent are immediately available.

In a further advantageous development of the present invention, the connecting rod is biased towards the circumference of the cleaning cloth take-up roll by means of a spring. This measure ensures, with a simple type of construction, that the control and drive for the cleaning cloth take-up roll aways delivers the same quantity of cleaning cloth, the resilience of the spring also ensuring simple exchange of a full roll of cleaning cloth.

In a further advantageous development of the present invention, the lever has a guide in which the end of the connecting rod is guided, and a pressure plate for the cleaning cloth, which faces the cleaning cloth take-up roll. In addition to reliable control of the cleaning cloth take-up roll, this also avoids the formation of folds during the taking-up of the cleaning cloth.

In accordance with an advantageous development of the present invention, the cleaning cloth shafts are axially stepped shafts for receiving the cleaning cloth rolls, the cleaning cloth rolls being fixed on the shafts by means of sleeves which can be brought into engagement with the reduced portions of the shafts. This construction enables the cleaning rolls to be secured to, and released from, the respective shafts in a simple manner, without the use of tools and without disassembling parts of the machine.

In accordance with a further construction of the washing apparatus in accordance with the invention, the cleaning cloth take-up and supply shafts are in the form of cantilevers. This renders it possible to exchange the cleaning cloth rolls in a simple manner, without having to release the washing apparatus from the printing machine.

Advantageously, thin-walled cardboard or plastics tubes are used as winding cores for the cleaning cloth, one of which cores carries the cleaning cloth supply roll and the other carriers the cleaning cloth take-up roll.

Finally, in a further advantageous development of the invention, the cleaning fluid feed comprises separate, interchangeable containers for cleaning fluid and water. This avoids troublesome flexible tubes and expensive flexible tube connectors which in turn can be the source of trouble, such as leaks.

The present invention will now be further described, by way of example, with reference to the accompanying drawings, in which:

FIG. 2 is a cross-sectional view of the cleaning cloth take-up roll or supply roll, of the apparatus of FIG. 1;

FIG. 3 is a schematic illustration of the drive for the cleaning cloth;

Figure 1:
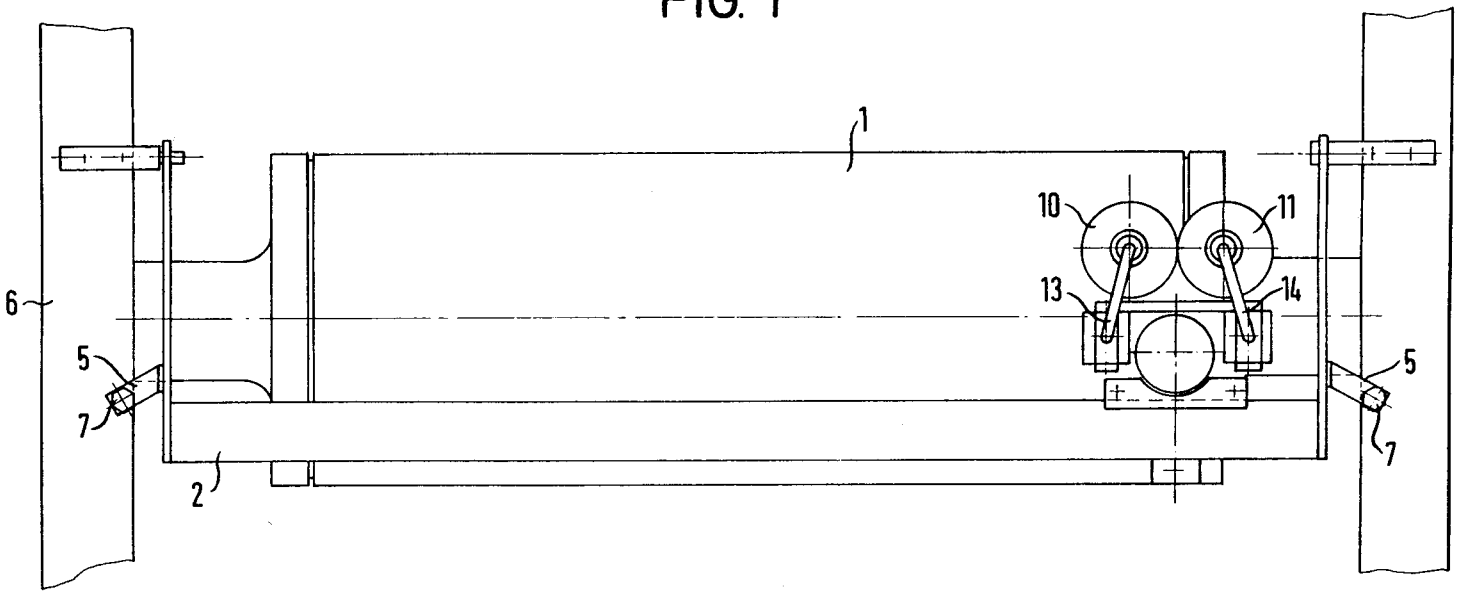
FIG. 1 is a general view of one embodiment of the washing apparatus of the present invention for use in cleaning a rubber blanket cylinder of a printing machine.

Referring to FIG. 1 of the drawings, a washing apparatus is associated with the rubber blanket cylinder 1 of an offset printing machine.

A guide bar 2 having a toothed rack 3 (see FIG. 4) formed thereon, extends parallel to the axis of the rubber blanket cylinder 1 and adjacent thereto, between the members of a frame 6. Hook-like mounting lugs 5 on which the washing apparatus is mounted so as to be suspended from the frame 6 of the printing machine, are secured to both ends of the guide bar 2. This type of fastening enables the washing apparatus to be adjusted radially of the rubber blanket cylinder 1 in a simple and reliable manner by means of the set screws 7.

In order to move the washing apparatus back and forth along the guide bar 2, a pinion 4 (see FIG. 4) is provided, which meshes with the toothed rack 3 and is driven by an electric motor 8. The electric motor 8 also serves as a drive for a reversible brush roller 9 and a control and drive means 12 for a cleaning cloth 26.

Two containers 10 and 11 for water and washing agent are disposed above the electric motor 8 and are connected to feed pumps 15 by way of lines 13, 14. Pressure lines 36 lead from the feed pumps 15 to two spray nozzles 16 whose jets are directed towards the brush roller 9. The brush roller 9 is wetted intermittently, this being effected by corresponding electrical control (not illustrated) or the pumps 15.

Figure 4:
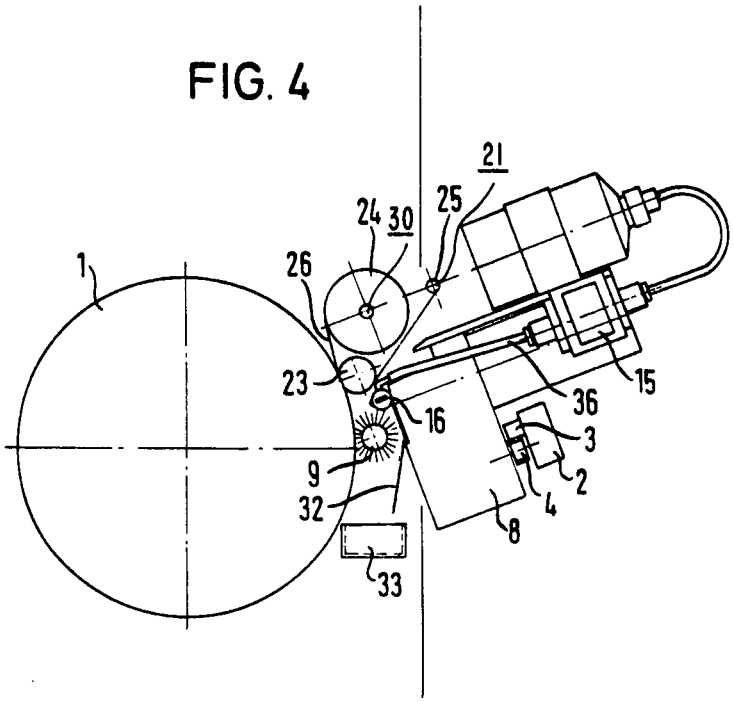
FIG. 4 is an end elevation of the washing apparatus of FIG. 1.

Referring to FIG. 4, the cleaning cloth 26 extends from a cleaning cloth supply shaft 30 disposed above the electric motor 8 via a guide roller 23 disposed therebelow to a cleaning cloth take-up shaft 21 which is disposed on a level with the cleaning cloth supply shaft 30 but downstream thereof. The cleaning cloth 26 is brought into contact with the rubber blanket cylinder 1 of the printing machine by means of the guide roller 23. The reversible brush roller 9 is disposed below the guide roller 23 and is also is contact with the periphery of the rubber blanket cylinder 1. A baffle plate 32 is provided at the side of the brush roller 9 which is remote from the rubber blanket cylinder 1 and deflects the fluid sprayed from the brush roller 9 to a collecting container 33 disposed therebelow.

The spray nozzles 16 for feeding cleaning fluid and water are provided between the brush roller 9 and the guide roller 23.

Referring to FIG. 3, the control and drive means 12 for the cleaning cloth 26 comprises a crank 17, a connecting rod 18 secured to the periphery of the crank 17, and a lever 19 which is disposed at the other end of the connecting rod 18 and which is provided with a guide 28 in which the end 22 of the connecting rod 18 is disposed so as to be slidable in the direction of the longitudinal axis of the lever 19. One end of the lever 19 is connected to the take-up shaft 21 by means of a one-way clutch 20, the lever 19 being pivotable about the take-up shaft 21. A pressure plate 29 for the cleaning cloth is provided at the side, facing the periphery of the cleaning cloth take-up roll 25 on shaft 21, contiguous to the end 22 of the connecting rod 18, which is guided in the guide 28 in the lever 19. The connecting rod 18 and thus also the pressure plate 29 are biased towards the periphery of the cleaning cloth take-up roll 25 by means of a spring 27.

The cleaning cloth 26 is wound onto roll 25 by way of the connecting rod 18 which is driven by the crank 17 and which pivots the lever 19 and rotates the take-up shaft 21 in a stepwise manner by way of the one-way clutch 20. The point at which the connecting rod 18 acts upon the lever 19, that is to say, the end 22 of the connecting rod, moves uniformly outwardly with increasing diameter of the cleaning cloth take-up roll 25, thereby automatically ensuring uniform feeding of the cleaning cloth. The provision of a further one-way clutch between the electric motor 8 and the crank 17 enable activation of the cleaning cloth feed in a desired manner only when the washing apparatus is operating in the reverse direction, i.e. against the direction of rotation of cylinder 1. This results in a very economic consumption of cleaning cloth and an optimum degree of cleaning.

The cleaning cloth supply and take-up rolls 24, 25 are disposed on respective shafts 30, 21 of the washing apparatus. As will be seen in FIG. 2 in connection with the shaft 30, the shafts 21, 30 are mounted in a cantilever manner and are supported at one end by means of a holder 34 and a ball bearing 35, the shaft being rotatable in the holder 34. The shafts 30, 21 have two portions 30*a*, 30*b* which are stepped relative to one another. While the winding core 38 of the cleaning cloth roll 25 is slipped on to the larger diameter portion 30*a*, a sleeve-like clamping device 37 is connected to the smaller diameter portion 30*b*. The clamping device 37 comprises a nut 31 by which two resilient clamping rings 39 can be deformed such that the latter establish a frictional connection between the portion 30*b*, and thus the shaft 30, and the sleeve 38 of the cleaning cloth roll 25.

Figure 5:
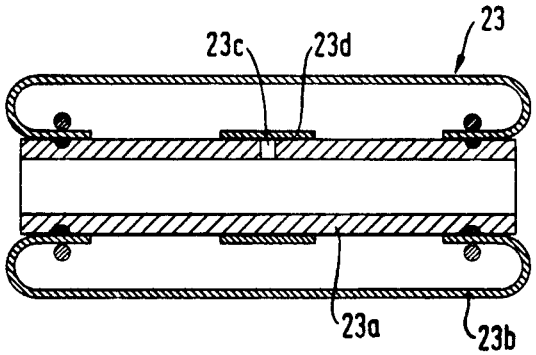
FIG. 5 shows one construction of guide roller suitable for use in the present invention.

Finally, FIG. 5 shows a special embodiment of the rotatable guide roller 23 constituting the means for pressing the cleaning cloth 26 against the rubber blanket cylinder 1. Accordingly, the guide roller 23 comprises a tubular portion 23*a* mounted on a shaft (not illustrated). A toroidal membrane 23*b* made from a resilient material is mounted on the outer surface of the tubular portion 23*a*. The annular space between the tubular portion 23*a* and the toroidal membrane 23*b* can be filled with compressed air. For this purpose, the tubular portion 23*a* has at least one bore which is covered by a valve diaphragm 23*d*. By means of this valve arrangement, compressed air can be introduced into the annular space between the tubular portion 23*a* and the toroidal membrane 23*b*. Advantageously, the toroidal membrane 23*b* has a substantially cylindrical surface, so that the cleaning cloth is applied satisfactorily to the rubber cylinder, at the same time ensuring that the cleaning cloth can be readily moved.

We claim:

1. Washing apparatus for a rubber blanket cylinder of a printing machine comprising:

a cleaning cloth having a width which is a fraction of the width of the rubber blanket cylinder;

a supply roller for said cleaning cloth;

a supply shaft for supporting said supply roller;

a take-up roller for said cleaning cloth;

a take-up shaft for supporting said take-up roller, said supply shaft and said take-up shaft both being axially stepped, said supply roller and said take-up roller being fixed on their respective supply and take-up shafts by sleeves engageable with reduced portions of said respective supply and take-up shafts;

means for pressing said cleaning cloth against the rubber blanket cylinder, said pressing means comprising a rotating guide roller over which the cleaning cloth is guided;

means for controlling and driving said cleaning cloth take-up roller for incremental take-up of constant lengths of cleaning cloth;

a rotatable brush roller disposed in contact with the rubber blanket cylinder and on a side of said pressing means wherein the rubber blanket cylinder contacts said brush roller prior to said pressing means when the rubber blanket cylinder is rotating;

means for supplying a cleaning liquid to said brush roller;

means for supplying water to said brush roller;

means for guiding and moving said washing apparatus across the width of the rubber blanket cylinder from a starting position to a second position and back to said starting position; and means for rotating said brush roller in a first direction as said washing apparatus is moved from said starting position to said second position and for rotating said brush roller in a second direction opposite of said first direction as said washing apparatus is moved from said second position to said starting position.

2. A washing apparatus according to claim 1, where said take-up shaft and said supply shaft are cantilever-mounted.

3. A washing apparatus according to claim 1, wherein separate interchangeable containers are provided for said cleaning liquid supplying means and said water supplying means.

4. A washing apparatus according to claim 1 wherein said controlling and driving means comprises:

a motor;

a crank driven by said motor;

a lever extending from said take-up shaft for rotation with said take-up shaft;

a connecting rod coupling said lever to said crank for rotating said take-up shaft and said lever in response to movement of said crank;

a one way clutch disposed on said take-up shaft; and means for adjusting the position of said connecting rod on said lever as a function of the size of the roll of cleaning cloth on said take-up roller.

5. A washing apparatus according to claim 4, wherein said connecting rod is biased toward the periphery of the roll of cleaning cloth disposed on said take-up roller by means of a spring.

6. A washing apparatus according to claim 4, wherein said lever has a guide in which the end of said connecting rod is guided, and wherein a pressure plate for the cleaning cloth is provided on that side of the end of said connecting rod which faces the cleaning cloth take-up roller.

* * * * *